US010665201B2

(12) United States Patent
Tominaga

(10) Patent No.: US 10,665,201 B2
(45) Date of Patent: May 26, 2020

(54) DISPLAY DEVICE

(71) Applicant: SHARP KABUSHIKI KAISHA, Sakai, Osaka (JP)

(72) Inventor: Masakatsu Tominaga, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/457,042

(22) Filed: Jun. 28, 2019

(65) Prior Publication Data

US 2020/0013366 A1 Jan. 9, 2020

Related U.S. Application Data

(60) Provisional application No. 62/693,544, filed on Jul. 3, 2018.

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01)

(58) Field of Classification Search
CPC .. G09G 3/3696; G09G 3/3677; G09G 3/3688; G09G 2320/0257; G09G 2310/08; G09G 2340/16
See application file for complete search history.

(56) References Cited

U.S. PATENT DOCUMENTS

| | | | | |
|---|---|---|---|---|
| 2009/0190047 | A1 | 7/2009 | Oomura | |
| 2014/0253531 | A1* | 9/2014 | Lee | G09G 3/3677 345/212 |
| 2016/0171933 | A1* | 6/2016 | Takahara | G09G 3/3233 345/212 |
| 2018/0068615 | A1* | 3/2018 | Imai | G09G 3/3677 |
| 2018/0113564 | A1* | 4/2018 | Takahashi | G09G 3/3266 |

FOREIGN PATENT DOCUMENTS

| | | | |
|---|---|---|---|
| JP | 2007-248536 | A | 9/2007 |
| JP | 2009-180826 | A | 8/2009 |

* cited by examiner

*Primary Examiner* — Andrew Sasinowski
(74) *Attorney, Agent, or Firm* — ScienBiziP, P.C.

(57) ABSTRACT

An object of an embodiment of the present invention is to suppress the occurrence of an afterimage on a display screen. In a period (A1) within a single frame period, a gate driver outputs a gate voltage (Vgh) to a gate line (GL1), and in a period (B1) coming after the period (A1) within the single frame period and also longer than the period (A1), the gate driver outputs the gate voltage (Vgh) to the gate line (GL1). In both the period (A1) and the period (B1), a source driver outputs a plurality of unchanged source voltages expressing information to be displayed by one row of pixels corresponding to the gate line (GL1) to a plurality of source lines.

8 Claims, 8 Drawing Sheets

(a)

(b)

DISPLAY DEVICE

TECHNICAL FIELD

The present invention relates to a display device and a display method.

BACKGROUND ART

FIG. 9 is a diagram illustrating (a photograph of) the pixel structure of an MVA-mode liquid-crystal display device 100 according to the related art. As illustrated in the diagram, in the MVA-mode liquid-crystal display device, inside the pixels, locations where the liquid-crystal alignment-restricting force is weak exist, such as at the edges of the pixel electrode. The alignment in such locations may change greatly depending on the difference between the voltage applied to the pixels in the frame currently being displayed (current frame) and the voltage applied to the pixels in previously displayed frame (previous frame). FIG. 10 is a diagram illustrating each waveform of the gate voltage, the source voltage, and the pixel voltage when the gate line is driven in the liquid-crystal display device 100 according to the related art.

In FIG. 10, the source voltage corresponding to black is 0V, while the source voltage corresponding to white is 5V (or −5V). The common voltage applied to common electrode is 0V. The first gate voltage is a high-level voltage able to sufficiently turn on the gate of the TFT. In the example of FIG. 10, the liquid-crystal display device 100 drives the gate line only once within a single frame period.

Consequently, the voltage for displaying is applied only once within a single frame period. In FIG. 10, an example of driving that changes the displayed color of a pixel from black to white is illustrated. By applying a 5V source voltage to the source electrode of the TFT and turning on the gate of the TFT, the drain voltage (pixel voltage) changes greatly from 0V (black) to 5V (white).

FIG. 11 is a diagram that explains how an afterimage occurs on the display screen in the MVA-mode liquid-crystal display device 100 according to the related art. In FIG. 11, in the previous frame, the liquid-crystal display device 100 is displaying black in a region 111 of the display screen and is displaying a neutral color in a region 112 disposed around the region 111. Additionally, in the current frame, the liquid-crystal display device 100 changes the entire display screen to white. In this case, the voltage applied to the pixel electrodes in the region 111 is changed from 0V (black) to 5V (white). On the other hand, the voltage applied to the pixel electrodes in the region 112 is changed from 2.5V (neutral) to 0V (white).

In the current frame, since the amount of change in the voltage applied to the pixel electrodes is small in the region 112, the alignment is not disturbed much in the locations of weak alignment-restricting force inside the pixels. Consequently, in the region 112, an afterimage does not occur, and white is displayed correctly. On the other hand, in the current frame, since the amount of change in the voltage applied to the pixel electrodes is large in the region 111, the alignment is disturbed greatly in the locations of weak alignment-restricting force inside the pixels. Because of this, in the current frame, a phenomenon occurs in which the brightness of the pixels in the region 112 becomes different than the brightness of the pixels in the region 111. As a result, the display color of the region 112 is influenced by the black in the previous frame, and is no longer displayed as white. Because of this, an afterimage of the color of the previous frame occurs in the region 111.

PTL 1 discloses a drive circuit of an active-matrix liquid-crystal display device provided with a plurality of video signal lines for respectively transmitting a plurality of video signals expressing an image to be displayed, a plurality of scan signal lines that intersect with the plurality of video signal lines, and a plurality of pixel-forming parts disposed in a matrix, each corresponding to an intersection point between the plurality of video signal lines and the plurality of scan signal lines, the drive circuit comprising: a scan signal line drive circuit that selectively drives the plurality of scan signal lines such that each scan signal line is selected during a preliminary charging period preset for each scan signal line and during a main charging period preset as a period after the preliminary charging period; and a video signal line drive circuit that applies a voltage obtained by adding a predetermined voltage to a voltage for expressing the image to be displayed to the plurality of video signal lines in an overlapping charging period that, in the main charging period for each scan signal line, overlaps with the preliminary charging period for a scan signal line other than each scan signal line, and applies the voltage for expressing the image to be displayed to the plurality of video signal lines in a period other than the overlapping charging period in the main charging period for each scan signal line, wherein the overlapping charging period for each scan signal line is a partial period in the main charging period for a scan signal line other than each scan signal line, and corresponds to a predetermined period from the start of the main charging period. Furthermore, PTL 1 also discloses that, according to the drive circuit, it is possible to provide a highly responsive liquid-crystal display device capable of achieving greater power savings, reduced size, and lowered costs.

PTL 2 discloses a liquid-crystal display device provided with: a plurality of pixels arranged in a matrix, each including a pixel electrode for applying a voltage to a liquid crystal placed between the pixel electrode and a counter electrode, and a switching element connected to the pixel electrode; a plurality of scan lines arranged in a column direction, which are commonly connected to the switching elements in a row direction; and a vertical scan circuit that supplies a scan signal controlling the switching elements between a conducting state and a non-conducting state to scan the pixels sequentially by each scan line. The scan signal includes a first conducting signal that sets the switching elements to the conducting state; a second conducting signal that sets the switching elements to the conducting state later than the first conducting signal, and a non-conducting signal that sets the switching elements to the non-conducting state between the first conducting signal and the second conducting signal. During a period in which the second conducting signal is being applied to a predetermined scan line, the vertical scan circuit applies the first conducting signal and the non-conducting signal to the scan line to be scanned next after the predetermined scan line. Furthermore, PTL 2 also discloses that, according to the liquid-crystal display device, it is possible to suppress the degradation of image quality caused by parasitic capacitance coupling between pixel electrodes and feed-through between pixels, and suppress the degradation of image quality caused by the occurrence of pixel defects over a plurality of rows.

CITATION LIST

Patent Literature

[PTL 1]
Japanese Unexamined Patent Application Publication No. 2007-248536

[PTL 2]

Japanese Unexamined Patent Application Publication No. 2009-180826

SUMMARY OF INVENTION

Technical Problem

However, with the technology according to Patent Literature 1 and 2, it is not possible to suppress the occurrence of an afterimage on the display screen.

An objective of one aspect of the present invention is to suppress the occurrence of an afterimage on the display screen.

Solution to Problem (1) One embodiment of the present invention is a display device comprising: a display unit including a plurality of gate lines, a plurality of source lines intersecting the plurality of gate lines, and a plurality of pixels formed at each intersection between the gate lines and the source lines; a gate driver that selects the plurality of gate lines individually, and in a first period within a single frame period stipulated for the selected gate line, outputs a first gate voltage to the selected gate line, and additionally, in a second period coming after the first period within the single frame period and also longer than the first period stipulated for the selected gate line, outputs a second gate voltage equal to the first gate voltage to the selected gate line; and a source driver that, in the first period, outputs an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputs the unchanged plurality of first source voltages to the plurality of source lines.

(2) Another embodiment of the present invention is a display device comprising: a display unit including a plurality of gate lines, a plurality of source lines intersecting the plurality of gate lines, and a plurality of pixels formed at each intersection between the gate lines and the source lines; a gate driver that selects the plurality of gate lines individually, and in a first period within a single frame period stipulated for the selected gate line, outputs a first gate voltage to the selected gate line, and additionally, in a second period coming after the first period within the single frame period stipulated for the selected gate line, outputs a second gate voltage higher than the first gate voltage to the selected gate line; and a source driver that, in the first period, outputs an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputs the unchanged plurality of first source voltages to the plurality of source lines.

(3) Also, in one embodiment of the present invention, in addition to the configuration of the above (1) or (2), the source driver outputs the plurality of first source voltages of the same polarity as the plurality of first source voltages or the plurality of second source voltages output in the first period to the plurality of source lines in the second period.

(4) Also, in one embodiment of the present invention, in addition to the configuration of any of the above (1) to (3), in a case in which the second period stipulated for the selected gate line overlaps with the first period stipulated for any other gate line disposed before the selected gate line, the gate driver additionally selects the other gate line during the second period.

(5) Also, in one embodiment of the present invention, in addition to the configuration of any of the above (1) to (4), in a case in which the first period corresponding to the selected gate line does not overlap with the second period stipulated for any of the gate lines disposed before the selected gate line, the source driver outputs the unchanged plurality of first source voltages to the plurality of source lines in the first period.

(6) One embodiment of the present invention is a display method executed by a display device provided with a display unit including a plurality of gate lines, a plurality of source lines intersecting the plurality of gate lines, and a plurality of pixels formed at each intersection between the gate lines and the source lines, the display method comprising: a first output step of selecting the plurality of gate lines individually, and in a first period within a single frame period stipulated for the selected gate line, outputting a first gate voltage to the selected gate line, and additionally, in a second period coming after the first period within the single frame period and also longer than the first period stipulated for the selected gate line, outputting a second gate voltage equal to the first gate voltage to the selected gate line; and a second output step of, in the first period, outputting an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputting the unchanged plurality of first source voltages to the plurality of source lines.

(7) Another embodiment of the present invention is a display method executed by a display device provided with a display unit including a plurality of gate lines, a plurality of source lines intersecting the plurality of gate lines, and a plurality of pixels formed at each intersection between the gate lines and the source lines, the display method comprising: a first output step of selecting the plurality of gate lines individually, and in a first period within a single frame period stipulated for the selected gate line, outputting a first gate voltage to the selected gate line, and additionally, in a second period coming after the first period within the single frame period stipulated for the selected gate line, outputting a second gate voltage higher than the first gate voltage to the selected gate line; and a second output step of, in the first period, outputting an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputting the unchanged plurality of first source voltages to the plurality of source lines.

Advantageous Effects of Invention

According to an embodiment of the present invention, it is possible to suppress the occurrence of an afterimage on the display screen.

DESCRIPTION OF EMBODIMENTS

Embodiment 1

(Configuration of Liquid-Crystal Display Device 1)

Figure 1:
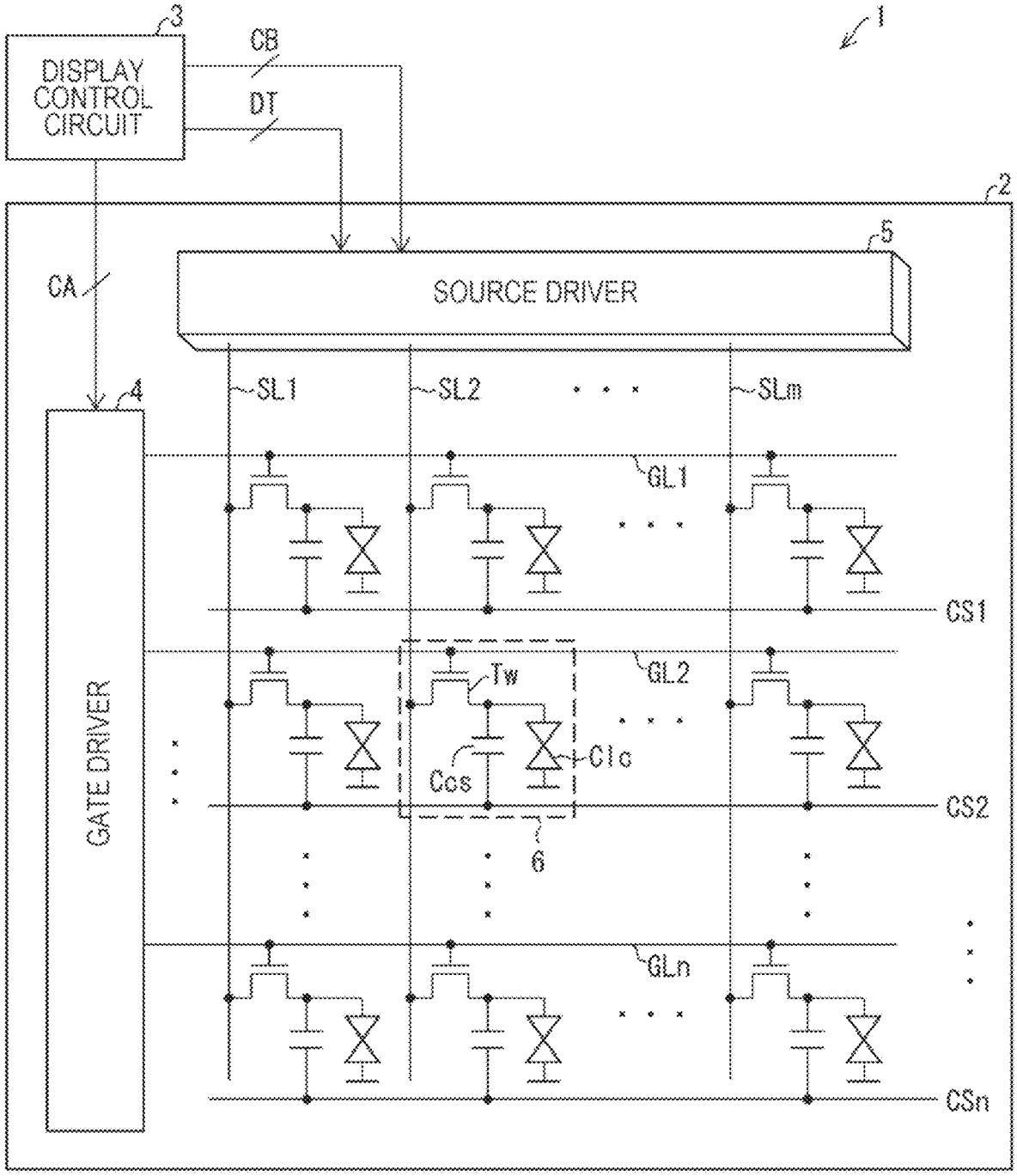
FIG. 1 is a block diagram illustrating a configuration of a liquid-crystal display device (display device) according to Embodiment 1 of the present invention.

FIG. 1 is a block diagram illustrating a configuration of a liquid-crystal display device 1 (display device) according to Embodiment 1 of the present invention. As illustrated in FIG. 1*i*, the illustrated liquid-crystal display device 1 is provided with a display unit 2, a display control circuit 3, a gate driver 4, and a source driver 5.

The display unit 2 includes n gate lines GL1 to GLn, m source lines SL1 to SLm, n storage capacitor lines CS1 to CSn, and (m×n) pixels 6.

The gate lines GL1 to GLn are disposed parallel to each other. The source lines SL1 to SLm are disposed parallel to each other and orthogonally to the gate lines GL1 to GLn. The gate lines GL1 to GLn and the source lines SL1 to SLm intersect at (m×n) locations. The (m×n) pixels 6 are disposed near the intersections of the gate lines GL1 to GLn and the source lines SL1 to SLm. The storage capacitor lines CS1 to CSn are disposed parallel to the gate lines GL1 to GLn.

Each pixel 6 includes a transistor Tw, a liquid-crystal capacitor Clc, and a storage capacitor Ccs. The gate electrode of the transistor Tw is connected to the corresponding gate line GL. The source electrode of the transistor Tw is connected to the corresponding source line SL. The drain electrode of the transistor Tw is connected to an electrode of both the liquid-crystal capacitor Clc and the storage capacitor Ccs. One electrode of the liquid-crystal capacitor Clc serves as a pixel electrode. The other electrode of the liquid-crystal capacitor Clc is connected to a common electrode (not illustrated). The other electrode of the storage capacitor Ccs is connected to the corresponding storage capacitor line. The storage capacitor lines CS1 to CSn are driven by a storage capacitor line driver (not illustrated) provided on the outside of the display unit 2.

The gate driver 4 and the source driver 5 are driver circuits of the liquid-crystal display device 1. The gate driver 4 drives the gate lines GL1 to GLn, and the source driver 5 drives the source lines SL1 to SLm. The display control circuit 3 outputs a control signal CA to the gate driver 4, and outputs a control signal CB and a data signal DT to the source driver 5. On the basis of the control signal CA, the gate driver 4 individually selects at least one gate line GL from among the gate lines GL1 to GLn, and outputs a gate voltage to the selected gate line GL. With this arrangement, one row of m pixels 6 corresponding to the selected gate line GL is selected collectively. On the basis of the control signal CB, the source driver 5 applies m source voltages according to the data signal DT to the source lines SL1 to SLm, respectively. With this arrangement, the m voltages are written to the selected m pixels 6, respectively.

(Configuration of Liquid-Crystal Display Device 1)

Figure 2:
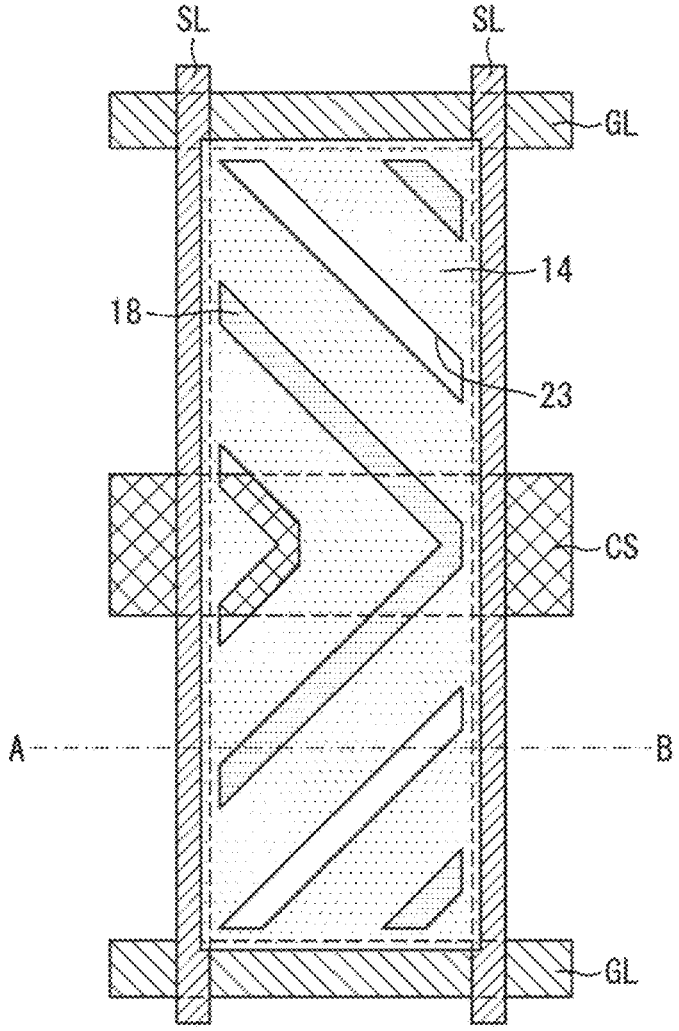
FIG. 2 is a diagram illustrating a detailed configuration of the liquid-crystal display device according to Embodiment 1 of the present invention.
Figure 2:
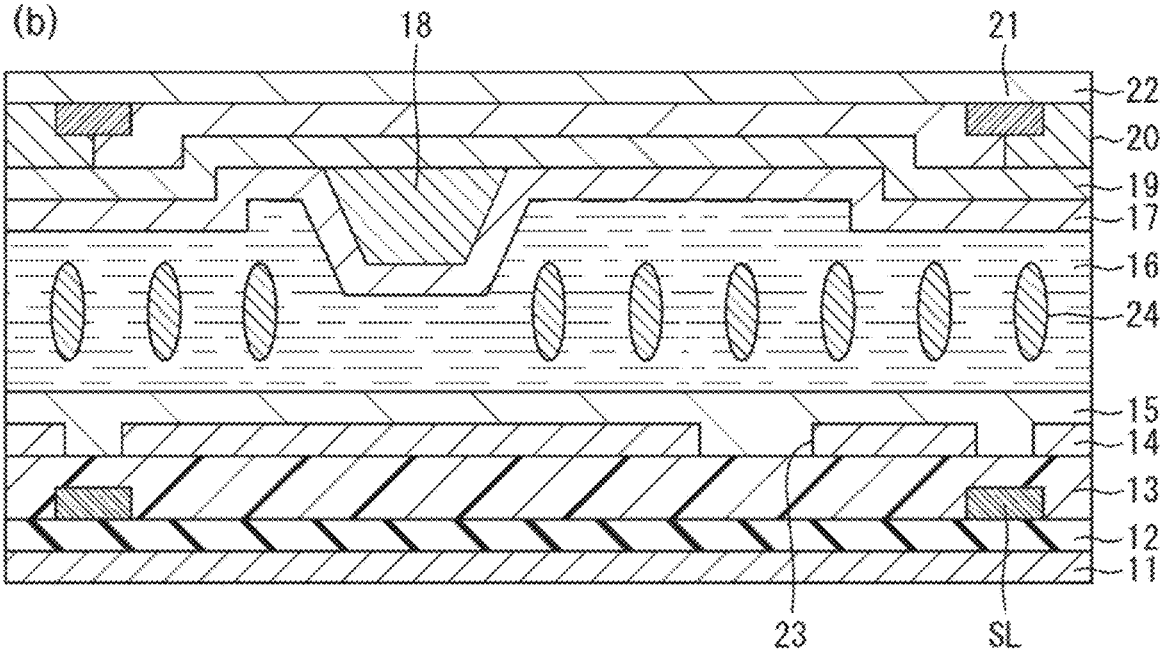

FIG. 2 is a diagram illustrating a detailed configuration of the liquid-crystal display device 1 according to Embodiment 1 of the present invention. (a) of FIG. 2 illustrates a plan-view configuration near a pixel 6, while (b) of FIG. 2 illustrates a cross-section of the A-B location in FIG. 2(*a*). As illustrated in the diagram, the liquid-crystal display device 1 is provided with an array substrate 11, a gate-insulating film 12, a resin layer 13, a pixel electrode 14, a polyimide layer 15, a liquid-crystal layer 16, a polyimide layer 17, a rib 18, a common electrode 19, a color filter 20, a black matrix 21, and a color filter substrate 22. The liquid-crystal display device 1 additionally is provided with a first polarizing plate and a second polarizing plate not illustrated. The first polarizing plate is provided on the array substrate 11, and the second polarizing plate is provided on the color filter substrate 22.

In the array substrate 11, in the pixel electrode 14, a slit 23 where part of the pixel electrode 14 is missing is formed. In the color filter substrate, a rib is formed at a position facing opposite the pixel electrode 14. The liquid-crystal layer 16 includes negative liquid crystals 24. In the state in which a voltage is not applied to the pixel electrode 14, the liquid crystals 24 are oriented vertically with respect to the array substrate 11 and the color filter substrate 22.

In the liquid-crystal display device 1, the polarizer included in the first polarizing plate and the polarizer included in the second polarizing plate are orthogonal to each other. In the state in which a voltage is not applied to the pixel electrode 14, since birefringence does not occur in the liquid crystals 24, the light of a backlight not illustrated is unable to be transmitted through the liquid-crystal layer 16. If a voltage is applied to the pixel electrode 14 and a common voltage is applied to the common electrode, the liquid crystals 24 are oriented in parallel with the array substrate 11 and the color filter substrate 22. In this way, by applying a voltage to change the orientation direction of the liquid crystals 24 from the vertical direction to the horizontal direction, birefringence occurs in the liquid-crystal layer 16. As a result, since the polarization direction of light in the liquid-crystal layer 16 changes, light from the backlight becomes able to be transmitted through the liquid-crystal layer 16.

The liquid-crystal display device 1 is not limited to a liquid-crystal display device 1 with a configuration corresponding to the multidomain vertical alignment (MVA) mode as illustrated in FIG. 2. For example, the liquid-crystal display device 1 may also be a liquid-crystal display device 1 with a configuration corresponding to another VA mode, such as CPA, fishbone, mono-domain VA, and UV2A, for example.

(Driving of Liquid-Crystal Display Device 1)

Figure 3:
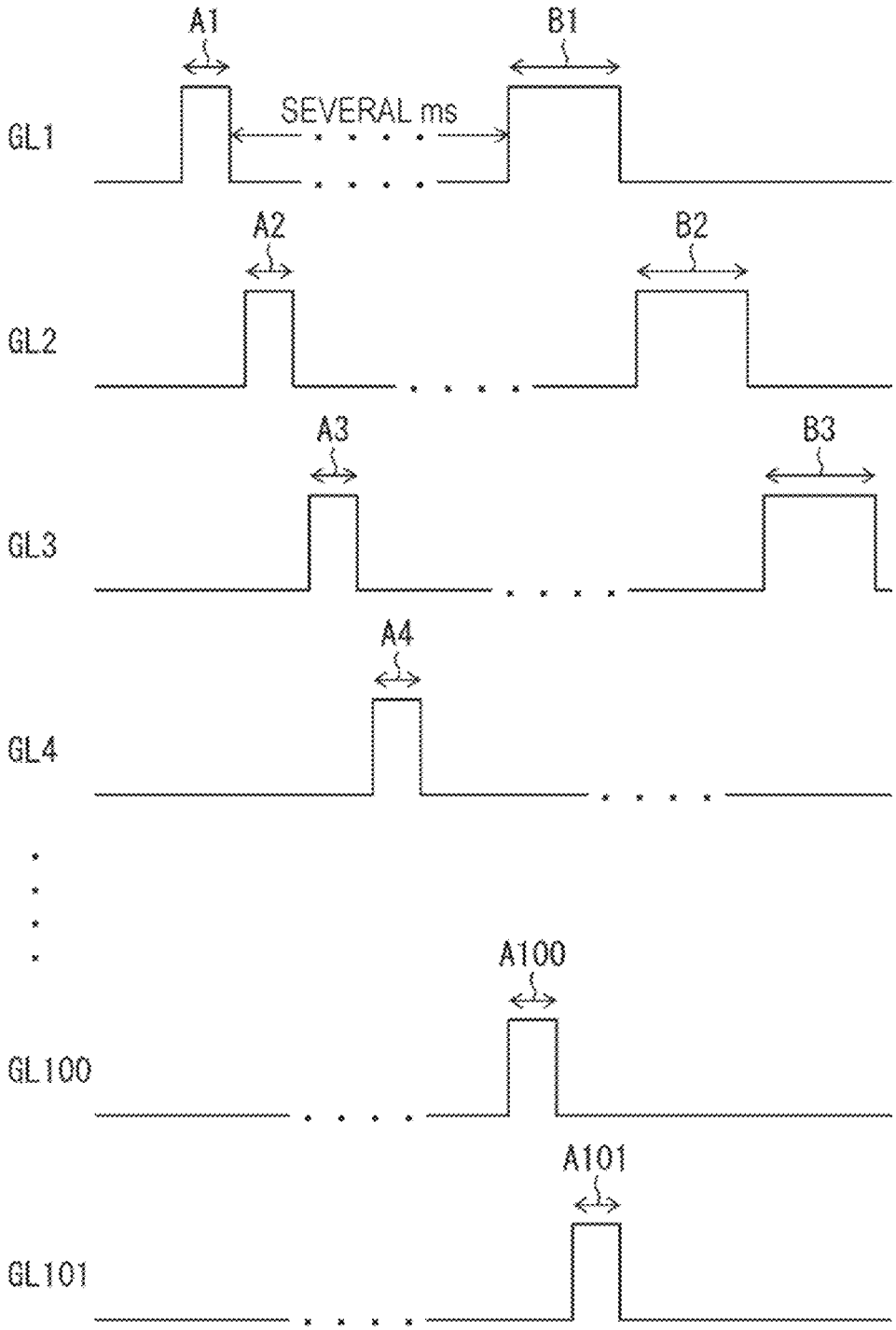
FIG. 3 is a diagram illustrating the waveforms of a gate voltage, a source voltage, and a drain voltage when the liquid-crystal display device according to Embodiment 1 of the present invention drives a display unit.

FIG. 3 is a diagram illustrating the waveforms of the gate voltage, the source voltage, and the drain voltage when the liquid-crystal display device 1 according to Embodiment 1 of the present invention drives the display unit 2. In the diagram, GL1 to GL4, GL100, and GL101 illustrate the waveform of each gate voltage output from the gate lines GL1 to GL4, GL100, and GL101, respectively.

In the liquid-crystal display device 1, for each gate line GL, a period A (first period) and a period B (second period) in which the gate line GL is driven within a single frame period are stipulated. For example, a period A1 and a period B1 are stipulated in advance for the gate line GL1, a period A2 and a period B2 are stipulated in advance for the gate line GL2, and a period A3 and a period B3 are stipulated in advance for the gate line GL3. Both the period A and the period B are included in a single frame period. The period B is disposed after the period A within a single frame period. The lengths of the periods A are equal to each other, and the lengths of the periods B are equal to each other. The period B is longer than the period A. In the example of FIG. 3, there are several milliseconds between the period A and the period B. In a single frame period, the positions where different periods A stipulated for different gate lines GL are disposed are different from each other. This is merely one example, and at least some of the periods A may also overlap with each other in a single frame period. In a single frame period, the positions where the periods B are disposed are different from each other.

In a single frame period, the gate driver 4 individually selects the gate lines GL1 to GLn. In the example of FIG. 3, first, the gate driver 4 selects the gate line GL1 from the gate lines GL1 to GLn. In the period A1 stipulated for the selected gate line GL1, the gate driver 4 outputs a voltage Vgh to the selected gate line GL1. With this arrangement, the gate line GL1 is driven (first driving). The period A1 stipulated for the gate line GL1 does not overlap the period B stipulated for any other gate line GL disposed after the gate line GL1. With this arrangement, in the period A1, the source driver 5 outputs multiple unchanged source voltages expressing information to be displayed by one row of the pixels 6 corresponding to the selected gate line GL1 to the source lines SL1 to SLm.

More specifically, the source driver 5 outputs multiple source voltages directly to the source lines SL1 to SLm, without adding a predetermined voltage to the multiple source voltages according to the data signal. Consequently, in the case in which the color of one row of the pixels 6 corresponding to the gate line GL1 is defined as white in the data signal of the current frame, during the first driving on the gate line GL1, a 5V source voltage expressing white is output directly to the source lines SL1 to SLm.

After the end of the period A1, the gate driver 4 selects the gate line GL2. In the period A2 stipulated for the selected gate line GL2, the gate driver 4 outputs the voltage Vgh to the selected gate line GL2. The period A2 stipulated for the gate line GL2 does not overlap the period B stipulated for any other gate line GL disposed after the gate line GL2. With this arrangement, in the period A2, the source driver 5 outputs multiple unchanged source voltages expressing information to be displayed by one row of the pixels 6 corresponding to the selected gate line GL2 to the source lines SL1 to SLm.

After the end of the period A2, the gate driver 4 sequentially selects the gate line GL3 and each gate line GL thereafter, and the drives the selected gate line GL similarly to the gate line GL1. In the example of FIG. 3, until the period B1 is started, the gate driver 4 sequentially selects the gate line GL3 to the gate line GL99, while in addition, in each of the periods A3 to A99, the gate driver 4 individually drives the gate lines GL3 to GL99 (first driving). In each of the periods A3 to A99, the source driver 5 outputs multiple unchanged source voltages expressing information to be displayed by one row of the pixels 6 corresponding to the selected gate line GL to the source lines SL1 to SLm. As a result, before the second driving of the gate line GL1 is executed, the first driving of the gate lines GL1 to GL99 is completed.

After the period A99, the gate driver 4 selects the gate line GL1 again. In the period B1 stipulated for the selected gate line GL1, the gate driver 4 outputs a voltage Vgh equal in magnitude to the voltage Vgh output in the period A1 to the gate line GL1. With this arrangement, the gate line GL1 is driven (second driving). In the period B1, the source driver 5 outputs multiple unchanged source voltages (first source voltages) expressing information to be displayed by one row of the pixels 6 corresponding to the selected gate line GL1 to the source lines SL1 to SLm. In this way, in the period A1 and the period B1, the same multiple source voltages corresponding to the same pixels 6 are output to the source lines SL1 to SLm.

The period B1 stipulated for the gate line GL1 overlaps with the period A100 stipulated for the gate line GL100 disposed after the gate line GL1. With this arrangement, the gate driver 4 additionally selects the gate line GL100 in the period A100. In other words, while the period B1 and the period A100 overlap, the gate driver 4 is selecting the gate line GL1 and the gate line GL100 simultaneously. In the period A100 stipulated for the selected gate line GL100, the gate driver 4 outputs the voltage Vgh to the gate line GL100. In this way, while the period B1 and the period A100 overlap, the liquid-crystal display device 1 is driving the gate line GL1 and the gate line GL100 simultaneously. Since this arrangement makes it possible to decrease the total number of drivings of the gate lines GL1 to GLn within a single frame period, the power consumption of the liquid-crystal display device 1 can be reduced.

From another perspective, the period A100 stipulated for the gate line GL100 overlaps with the period B1 stipulated for the gate line GL1 disposed before the gate line GL100. With this arrangement, in the period A100, the source driver 5 continues to output the multiple source voltages already output. In other words, at the start point of the period A100, the source driver 5 has already output multiple unchanged source voltages (second voltages) expressing information to be displayed by one row of the pixels 6 corresponding to the gate line GL1 disposed before the selected gate line GL100 to the source lines SL1 to SLm. With this arrangement, the source driver 5 uses the multiple source voltages output in the period B1 to charge each of the pixels 6 corresponding to the gate line GL1 with a second drain voltage (charging in the period B1), while also charging each of the pixels 6 corresponding to the gate line GL100 with a first drain voltage (charging in the period A100). In other words, the source driver 5 uses common source voltages to execute the second charging of each of the pixels 6 on the 1st row and the first charging of each of the pixels 6 on the 100th row simultaneously in the period (the first half of the period B1) during which the period B1 and the period A100 overlap. With this arrangement, the multiple source voltages for charging each of the pixels 6 corresponding to the gate line GL100 with the first drain voltage are already output without outputting source voltages separately in the period A100. Consequently, the power consumption of the liquid-crystal display device 1 can be reduced.

In the example of FIG. 3, the period A101 stipulated for the gate line GL101 also overlaps with the period B1. With this arrangement, while the period B1 and the period A101 overlap, the gate driver 4 selects the gate line GL1 and the gate line GL101 simultaneously. Also, the source driver 5 uses the multiple source voltages output in the period B1 to charge each of the pixels 6 corresponding to the gate line GL1 with a second drain voltage (charging in the period B1), while also charging each of the pixels 6 corresponding to the gate line GL101 with a first drain voltage (charging in the period A101). In other words, the source driver 5 uses common source voltages to execute the second charging of each of the pixels 6 on the 1st row and the first charging of each of the pixels 6 on the 101st row simultaneously in the period (the second half of the period B1) during which the period B1 and the period A101 overlap.

Since the first driving and the second driving targeting each of the gate lines GL3 to GLn in the period B2 stipulated for the gate line GL3 and thereafter are all substantially the same as the driving in the period A100 or A101 (first driving) and the driving in the period B1 (second driving), a detailed description is omitted.

Description of Effects

Figure 4:
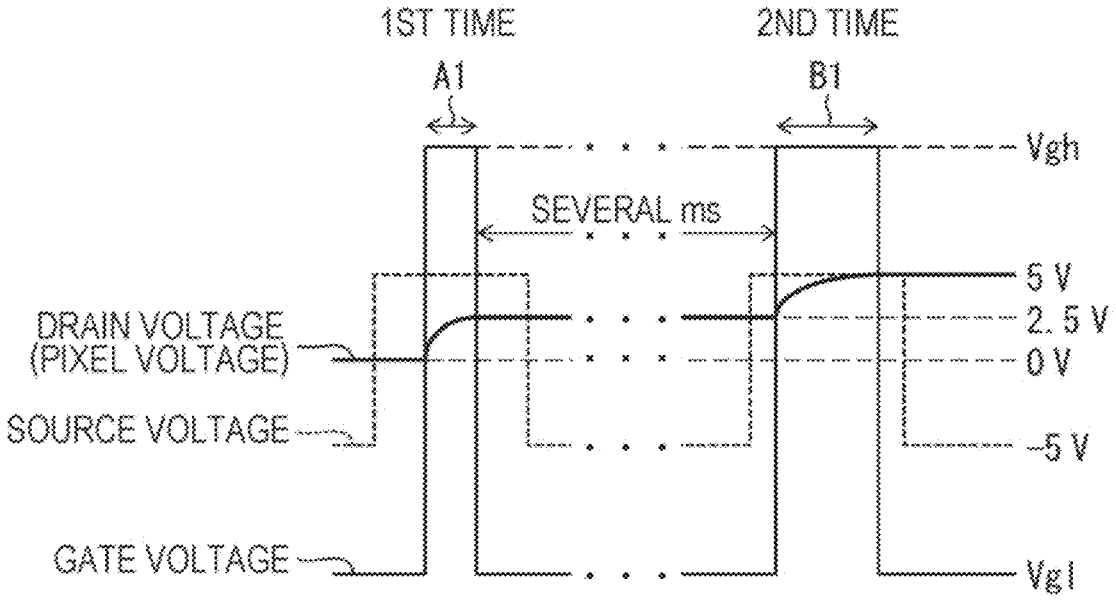
FIG. 4 is a diagram illustrating each waveform of a gate voltage, a source voltage, and a pixel voltage when a gate line is driven in the liquid-crystal display device according to Embodiment 1 of the present invention.

FIG. 4 is a diagram illustrating each waveform of the gate voltage, the source voltage, and the pixel voltage when the gate line GL1 is driven in the liquid-crystal display device 1 according to Embodiment 1 of the present invention. In FIG. 4, the source voltage corresponding to black is 0V, while the source voltage corresponding to white is 5V (or −5V). The common voltage applied to common electrode is 0V. The voltage Vgh is a high-level voltage able to sufficiently turn on the gate of the transistor Tw.

As illustrated in FIG. 4, in a single frame period, the gate driver 4 drives the gate line GL1 twice in a fixed amount of time. The driving in the period A1 is the first driving, and the driving in the period B1 is the second driving. In both the first and second drivings, the same voltage Vgh is input into the gate electrode of the transistor Tw. Furthermore, a source voltage of the same magnitude is applied to the source electrode of the transistor Tw. When the voltage Vgh is applied to the gate electrode of the transistor Tw, the gate of the transistor Tw opens. With this arrangement, a current according to the source electrode flows in the channel layer of the transistor Tw, and as a result, the drain electrode of the transistor Tw is charged.

Since the period A1 is shorter than the period B1, the time during which the transistor Tw is on in the first driving is shorter than the second driving. With this arrangement, the first driving has a smaller charge rate of the drain electrode of the transistor Tw than the second driving. In the example of FIG. 4, the charge rate of the drain electrode in the first driving is approximately 50% of the second. Consequently, the potential of the pixel electrode 14 is changed from 0V (black) before the driving to 2.5V (neutral) by the first driving within a single frame period. Additionally, the potential of the pixel electrode 14 is changed from 2.5V to 5V (white) by the second driving within a single frame period.

In the example of FIG. 4, in a single frame period, the color of a pixel 6 first changes from black to neutral (gray), and then after a fixed time, changes to white. In the first driving, since the change in the voltage applied to the pixel electrode 14 is not very large, an alignment disturbance of the liquid crystals 24 is less likely to occur in the locations of weak alignment-restricting force, such as at the edges of the pixel electrode 14. Furthermore, in the second driving, since the change in the voltage applied to the pixel electrode 14 likewise is not very large, an alignment disturbance of the liquid crystals 24 similarly is less likely to occur in the locations of weak alignment-restricting force, such as at the edges of the pixel electrode 14. Because of this, the occurrence of an afterimage on the display screen can be suppressed.

Figure 5:
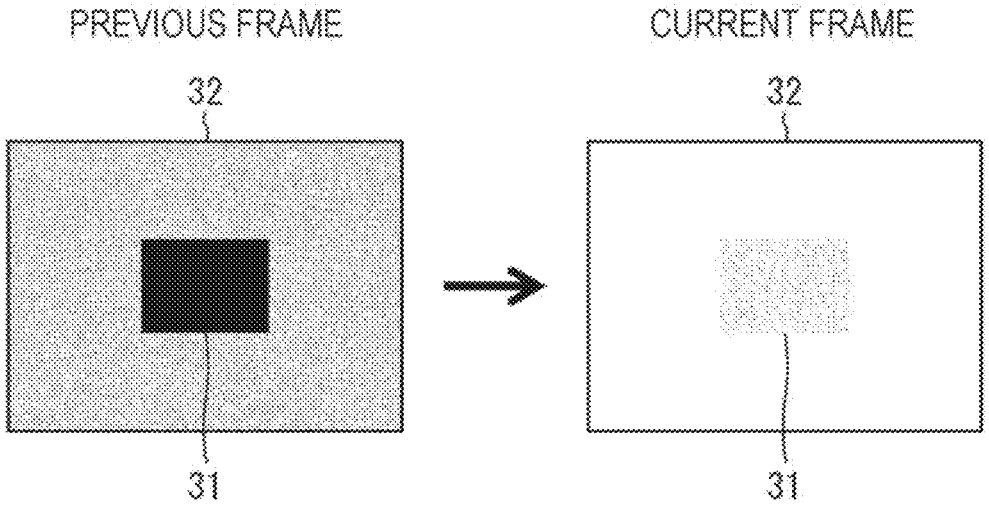
FIG. 5 is a diagram explaining how an afterimage does not occur on the display screen in the liquid-crystal display device according to Embodiment 1 of the present invention.

FIG. 5 is a diagram explaining how the occurrence of an afterimage on the display screen is suppressed in the liquid-crystal display device 1 according to Embodiment 1 of the present invention. In the example of FIG. 5, in the previous frame, the liquid-crystal display device 1 is displaying black in a region 31 of the display screen and is displaying a neutral color in a region 32 disposed around the region 31. In the current frame, the liquid-crystal display device 1 changes the entire display screen to white. In this case, the voltage applied to the pixel electrodes 14 in the region 31 is changed from 0V (black) to 2.5V (neutral) by the first driving, and after that, is changed from 2.5V to 5V (white) by the second driving. On the other hand, the voltage applied to the pixel electrodes 14 in the region 32 is maintained at 2.5V (neutral) by the first driving, and after that, is changed from 2.5V to 5V (white) by the second driving.

In the current frame, since the amount of change in the voltage applied to the pixel electrodes 14 is small in the region 32, the alignment is not disturbed much in the locations of weak alignment-restricting force inside the pixels 6. Consequently, in the region 32, an afterimage does not occur, and white is displayed correctly in the current frame. On the other hand, in the current frame, since the amount of change in the voltage applied to the pixel electrodes 14 is also small in both the first driving and the second driving in the region 32, the alignment is not disturbed much in the locations of weak alignment-restricting force inside the pixels 6. Consequently, an afterimage likewise does not occur in the region 31, and white is displayed correctly after displaying a neutral color in the current frame. With this arrangement, the occurrence of an afterimage is suppressed throughout the entire display screen.

In the example illustrated in FIGS. 3 to 5, since there are several milliseconds between the period A and the period B, the liquid crystals 24 are able to respond sufficiently during the first driving. With this arrangement, since the neutral color can be displayed reliably during the first driving, an afterimage can be suppressed effectively. In the case in which there are several milliseconds between the period A and the period B, after the first driving of the gate line GL1 in the period A1 ends, the liquid-crystal display device 1 is able to execute the first driving targeting as many gate lines GL as possible from the gate line GL2 within the period of several milliseconds until the period B1 arrives. In the example of FIG. 4, the first driving targeting the 98 gate lines from GL2 to GL99 is executed before the second driving targeting the gate line GL1.

The source driver 5 preferably outputs multiple source voltages of the same polarity as the multiple source voltages output to the source lines SL1 to SLm in the period A to the source lines SL1 to SLm in the period B. For example, in the case in which the source driver 5 outputs multiple source voltages of positive polarity (5V) to the source lines SL1 to SLm in the period A1, the source driver 5 also outputs multiple source voltages of positive polarity (5V) to the source lines SL1 to SLm in the period B1. For example, in the case in which the source driver 5 outputs multiple source voltages of negative polarity (−5V) to the source lines SL1 to SLm in the period A2, the source driver 5 also outputs multiple source voltages of negative polarity (−5V) to the source lines SL1 to SLm in the period B2. In these cases, the voltage applied to the same pixel electrode 14 in a single frame period does not change from positive polarity to negative polarity or from negative polarity to positive polarity. As a result, since the change in the voltage applied to the same pixel electrode 14 in a single frame period is small, the occurrence of an afterimage can be suppressed effectively.

Figure 6:
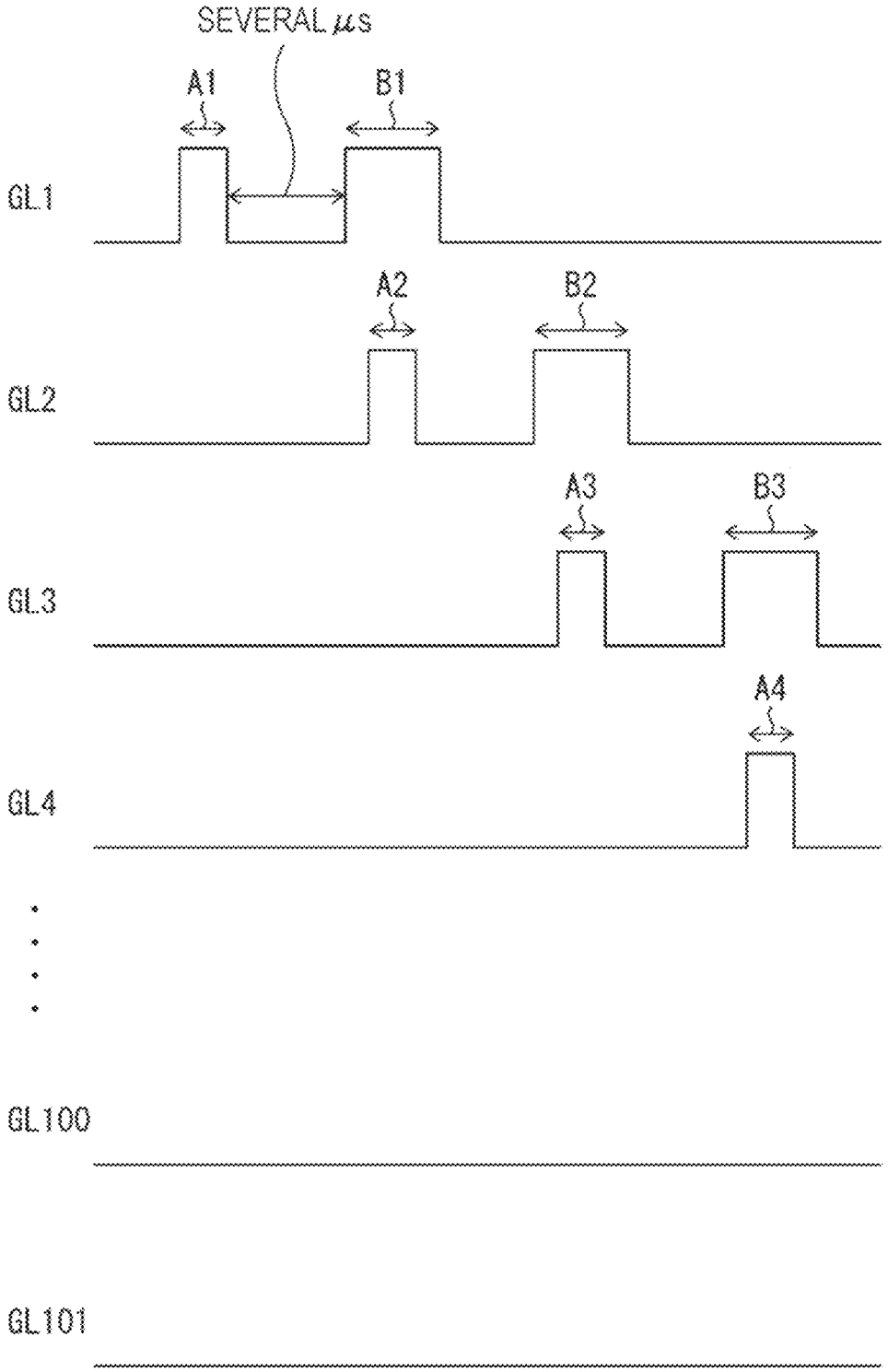
FIG. 6 is a diagram illustrating another example of the waveforms of the gate voltage, the source voltage, and the drain voltage when the liquid-crystal display device according to Embodiment 1 of the present invention drives the display unit.

FIG. 6 is a diagram illustrating another example of the waveforms of the gate voltage, the source voltage, and the drain voltage when the liquid-crystal display device 1 according to Embodiment 1 of the present invention drives the display unit 2. In the example illustrated in this diagram, there are several microseconds between the period A and the period B stipulated for each gate line GL. Even in the case in which the interval between the period A1 and the period A2 is shorter than several milliseconds as illustrated in FIG. 6, an effect of suppressing an afterimage is obtained.

Embodiment 2

Figure 7:
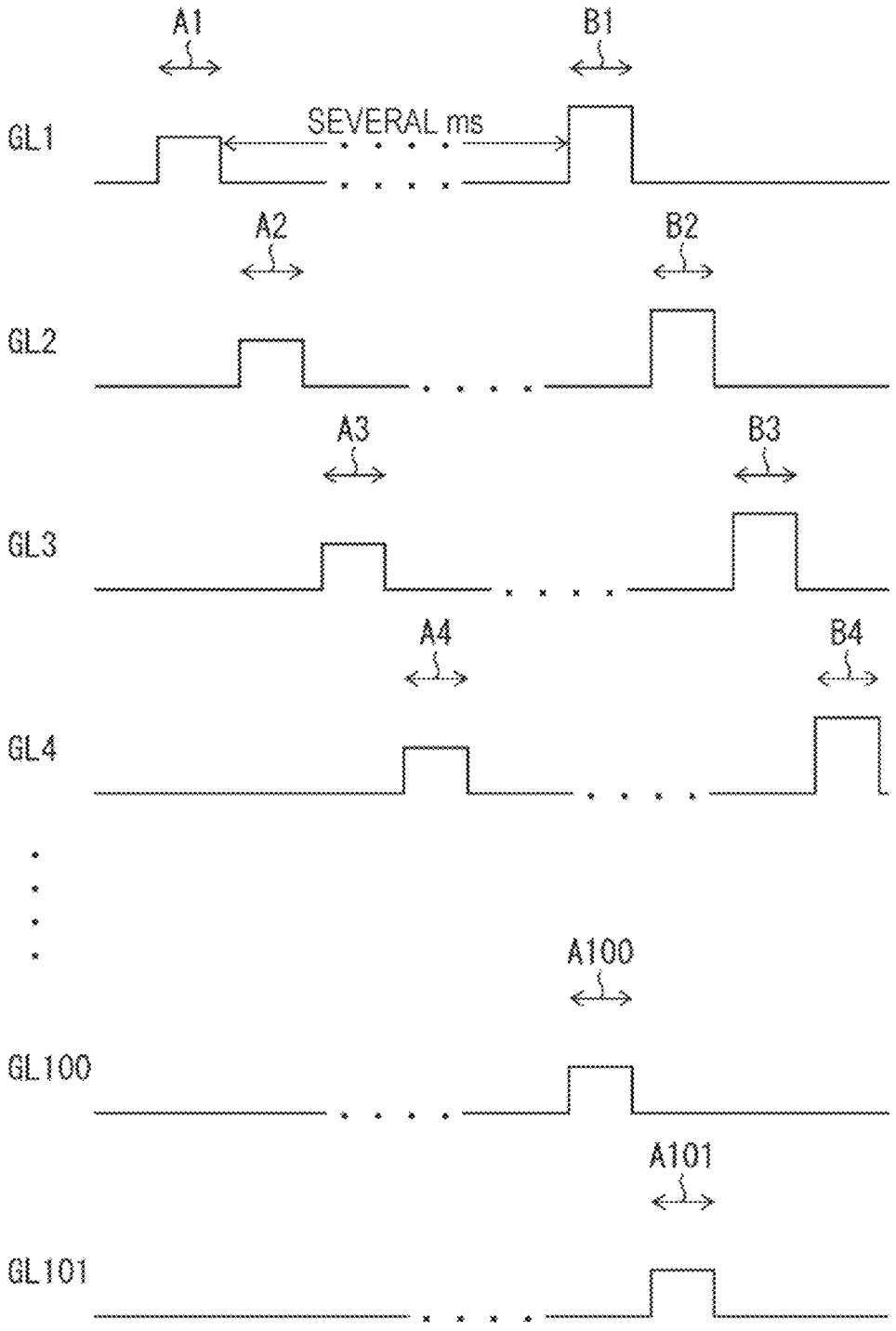
FIG. 7 is a diagram illustrating the waveforms of the gate voltage, the source voltage, and the drain voltage when the liquid-crystal display device according to Embodiment 2 of the present invention drives the display unit.

FIG. 7 is a diagram illustrating the waveforms of the gate voltage, the source voltage, and the drain voltage when the liquid-crystal display device 1 according to Embodiment 2 of the present invention drives the display unit 2. In the present embodiment, the configuration of the liquid-crystal display device 1 is the same as Embodiment 1. However, in the present embodiment, the method of driving the display unit 2 by the liquid-crystal display device 1 is partially different from Embodiment 1. Likewise in the liquid-crystal display device 1 according to the present embodiment, for each gate line GL, a period A and a period B in which the gate line GL is driven within a single frame period are stipulated. In the present embodiment, unlike Embodiment 1, the length of each period B is the same as each period A. Furthermore, the gate voltage (voltage Vgh2, first gate voltage) output to each gate line GL in each period A is lower than the gate voltage (voltage Vgh, second gate voltage) output to each gate line GL in each period B.

In the example illustrated in FIG. 7, the procedure by which the gate driver 4 drives each gate line GL is basically the same as Embodiment 1. The characteristic part of Embodiment 2 is described as follows. The gate driver 4 selects the gate line GL1 from among the gate lines GL1 to GLn. In the period A1 stipulated for the selected gate line GL1, the gate driver 4 outputs the voltage Vgh2 to the gate line GL1. The voltage Vgh2 is lower than the voltage Vgh, but is a voltage able to turn on the gate of the transistor Tw to some degree. In the period B1 of the same length as the period A1 stipulated for the gate line GL1, the gate driver 4 outputs the voltage Vgh that is higher than the voltage Vgh2 to the gate line GL1. Since the output of the multiple source voltages in the period A1 and the period B1 is the same as Embodiment 1, a detailed description is omitted.

Figure 8:
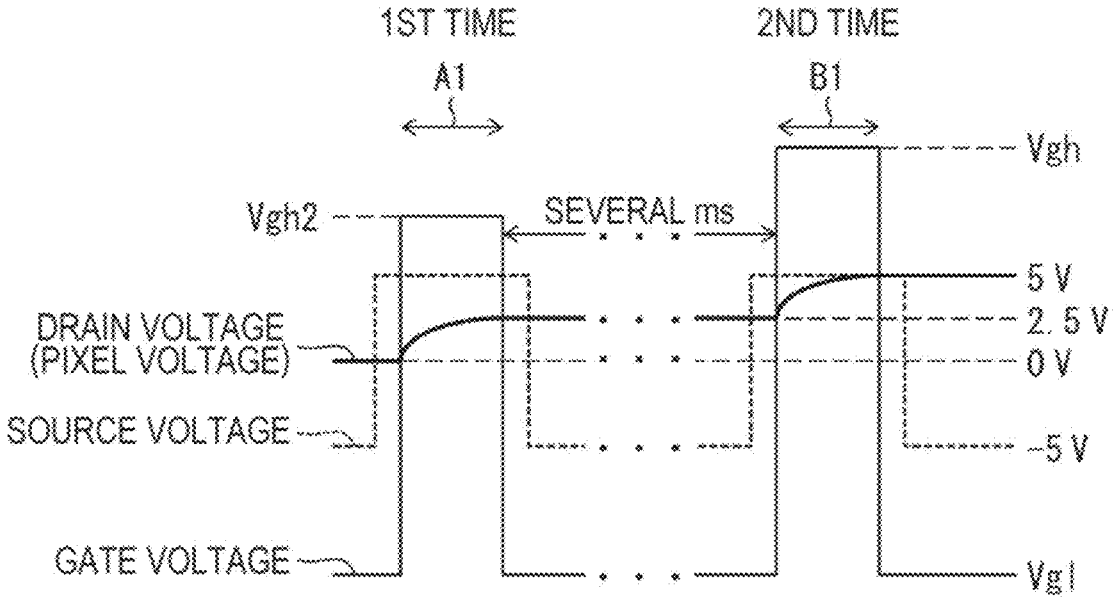
FIG. 8 is a diagram illustrating each waveform of the gate voltage, the source voltage, and the pixel voltage when the gate line is driven in the liquid-crystal display device according to Embodiment 2 of the present invention.
Figure 9:
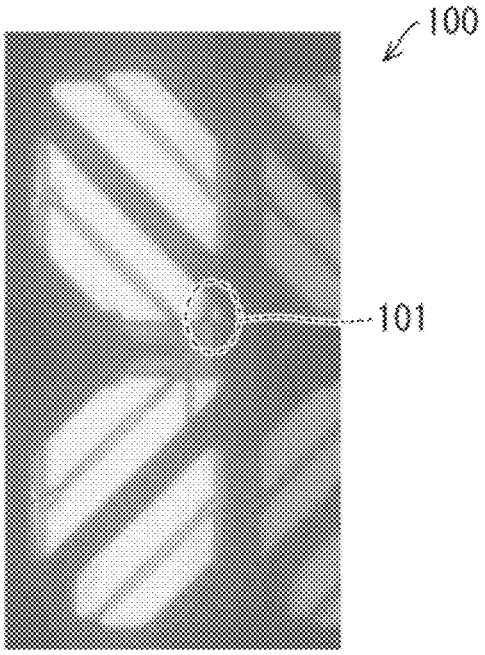
FIG. 9 is a diagram illustrating (a photograph of) the pixel structure of an MVA-mode liquid-crystal display device according to the related art.
Figure 10:
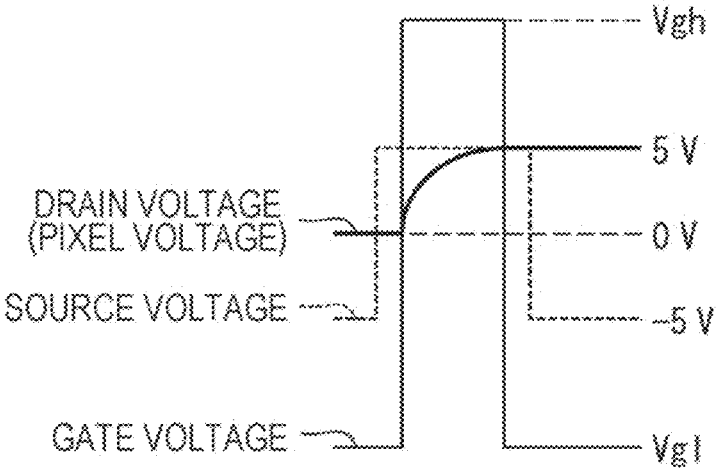
FIG. 10 is a diagram illustrating each waveform of the gate voltage, the source voltage, and the pixel voltage when the gate line is driven in the liquid-crystal display device according to the related art.
Figure 11:
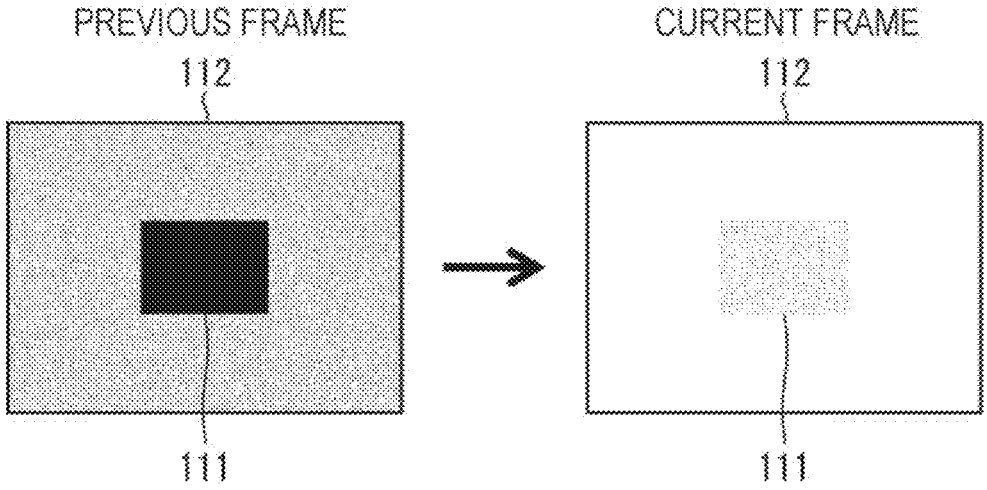
FIG. 11 is a diagram that explains how an afterimage occurs on the display screen in the MVA-mode liquid-crystal display device according to the related art.

FIG. 8 is a diagram illustrating each waveform of the gate voltage, the source voltage, and the pixel voltage when the gate line GL1 is driven in the liquid-crystal display device 1 according to Embodiment 2 of the present invention. As illustrated in the diagram, in a single frame period, the gate driver 4 drives the gate line GL1 twice in a fixed amount of time. The driving in the period A1 is the first driving, and the driving in the period B1 is the second driving. In the first driving, the voltage Vgh2 is input into the gate electrode of the transistor Tw, and in the second driving, the voltage Vgh is input into the gate electrode of the transistor Tw. Furthermore, in both the first driving and the second driving, the same source voltage is applied to the source electrode of the transistor Tw. When the voltage Vgh or the voltage Vgh2 is applied to the gate electrode of the transistor Tw, the gate of the transistor Tw opens, a current according to the source electrode flows in the channel layer of the transistor Tw, and as a result, the drain electrode of the transistor Tw is charged.

Since the lengths of the period A1 and the period B1 are the same, in both the first driving and the second driving, the transistor Tw is turned on for the same amount of time. In the present embodiment, the voltage Vgh2 applied to the gate electrode of the transistor Tw during the first driving is lower than the voltage Vgh applied to the gate electrode of the transistor Tw during the second driving. With this arrangement, the first driving has a smaller charge rate of the drain electrode of the transistor Tw than the second driving. In the example of FIG. 8, the charge rate of the drain electrode in the first driving is approximately 50% of the second. Consequently, the potential of the pixel electrode 14 is changed from 0V (black tone) before the driving to 2.5V (neutral tone) by the first driving within a single frame period. The potential of the pixel electrode 14 additionally is changed from 2.5V to 5V (white tone) by the second driving within a single frame period.

As above, in the liquid-crystal display device 1 according to the present embodiment, since a neutral color is inserted partway through when the color of the pixels 6 changes within a single frame period, the occurrence of an afterimage on the display screen can be suppressed similarly to Embodiment 1.

Although omitted from illustration, in the present embodiment, there may also be several microseconds between the period A and the period B stipulated for each gate line GL, similarly to Embodiment 1. Even in this case, an effect of suppressing an afterimage is obtained.

The present disclosure is not limited to the embodiments discussed above, and various modifications are possible within the scope indicated by the claims. Embodiments obtained by appropriately combining the technical means respectively disclosed in different embodiments are also included within the technical scope of the present disclosure. Furthermore, new technical features may be formed by combining the technical means respectively disclosed in each of the embodiments.

REFERENCE SIGNS LIST 1 liquid-crystal display device
2 display unit

3 display control circuit
4 gate driver
5 source driver
6 pixel
11 array substrate
14 pixel electrode
15, 17 polyimide layer
16 liquid-crystal layer
18 rib
19 common electrode
20 color filter
21 black matrix
22 color filter substrate
23 slit
24 liquid crystal
GL gate line
SL source line
Vgh, Vgh2 voltage

What is claimed is:

1. A display device comprising:

a display unit including a plurality of gate lines, a plurality of source lines intersecting the plurality of gate lines, and a plurality of pixels formed at each intersection between the gate lines and the source lines;

a gate driver that selects the plurality of gate lines individually, and in a first period within a single frame period stipulated for the selected gate line, outputs a first gate voltage to the selected gate line, and additionally, in a second period coming after the first period within the single frame period and also longer than the first period stipulated for the selected gate line, outputs a second gate voltage equal to the first gate voltage to the selected gate line; and a source driver that, in the first period, outputs an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputs the unchanged plurality of first source voltages to the plurality of source lines.

2. The display device according to claim 1, wherein the source driver outputs the plurality of first source voltages of the same polarity as the plurality of first source voltages or the plurality of second source voltages output in the first period to the plurality of source lines in the second period.

3. The display device according to claim 1, wherein in a case in which the second period stipulated for the selected gate line overlaps with the first period stipulated for any other gate line disposed before the selected gate line, the gate driver additionally selects the other gate line during the second period.

4. The display device according to claim 1, wherein in a case in which the first period corresponding to the selected gate line does not overlap with the second period stipulated for any of the gate lines disposed before the selected gate line, the source driver outputs the unchanged plurality of first source voltages to the plurality of source lines in the first period.

5. A display device comprising:

a display unit including a plurality of gate lines, a plurality of source lines intersecting the plurality of gate lines, and a plurality of pixels formed at each intersection between the gate lines and the source lines;

a gate driver that selects the plurality of gate lines individually, and in a first period within a single frame period stipulated for the selected gate line, outputs a first gate voltage to the selected gate line, and additionally, in a second period coming after the first period within the single frame period stipulated for the selected gate line, outputs a second gate voltage higher than the first gate voltage to the selected gate line; and a source driver that, in the first period, outputs an unchanged plurality of first source voltages expressing information to be displayed by one row of the pixels corresponding to the selected gate line or an unchanged plurality of second source voltages expressing information to be displayed by one row of the pixels corresponding to any other gate line disposed before the selected gate line to the plurality of source lines, and additionally, in the second period, outputs the unchanged plurality of first source voltages to the plurality of source lines.

6. The display device according to claim 5, wherein the source driver outputs the plurality of first source voltages of the same polarity as the plurality of first source voltages or the plurality of second source voltages output in the first period to the plurality of source lines in the second period.

7. The display device according to claim 5, wherein in a case in which the second period stipulated for the selected gate line overlaps with the first period stipulated for any other gate line disposed before the selected gate line, the gate driver additionally selects the other gate line during the second period.

8. The display device according to claim 5, wherein in a case in which the first period corresponding to the selected gate line does not overlap with the second period stipulated for any of the gate lines disposed before the selected gate line, the source driver outputs the unchanged plurality of first source voltages to the plurality of source lines in the first period.

* * * * *